US007660547B2

(12) United States Patent
Takiguchi et al.

(10) Patent No.: US 7,660,547 B2
(45) Date of Patent: Feb. 9, 2010

(54) CHARGING DEVICE

(75) Inventors: Toshiki Takiguchi, Yamatokoriyama (JP); Masato Kuze, Yamatokori (JP); Yuji Kumagai, Yamatokoriyama (JP); Hirokazu Yamauchi, Uji (JP); Hiroyuki Murai, Yamatokoriyama (JP)

(73) Assignee: Sharp Kabushiki Kaisha, Osaka (JP)

( * ) Notice: Subject to any disclaimer, the term of this patent is extended or adjusted under 35 U.S.C. 154(b) by 208 days.

(21) Appl. No.: 11/822,602

(22) Filed: Jul. 9, 2007

(65) Prior Publication Data

US 2008/0085134 A1 Apr. 10, 2008

(30) Foreign Application Priority Data

Jul. 10, 2006 (JP) ..... 2006-189639

(51) Int. Cl.
*G03G 15/02* (2006.01)

(52) U.S. Cl. ..... 399/100

(58) Field of Classification Search ..... 399/98, 399/100, 168, 170, 173
See application file for complete search history.

(56) References Cited

U.S. PATENT DOCUMENTS

| | | | | |
|---|---|---|---|---|
| 5,012,093 | A * | 4/1991 | Shimizu | 399/100 |
| 6,931,225 | B2 * | 8/2005 | Yamashita | 399/100 |
| 6,963,705 | B2 * | 11/2005 | Quinones | 399/100 |
| 2005/0074256 | A1 | 4/2005 | Yamashita | |
| 2005/0265745 | A1 | 12/2005 | Takesawa et al. | |
| 2007/0053718 | A1 | 3/2007 | Choi | |
| 2007/0212105 | A1 | 9/2007 | Azumi et al. | |

FOREIGN PATENT DOCUMENTS

| | | |
|---|---|---|
| JP | 07-319260 | 12/1995 |
| JP | 09-166906 | 6/1997 |
| JP | 09-211940 | 8/1997 |
| JP | 11-249393 | 9/1999 |
| JP | 11-288149 | 10/1999 |
| JP | 11-338265 | 12/1999 |

OTHER PUBLICATIONS

Office Action dated Mar. 10, 2009 issued in copending U.S. Appl. No. 11/819,219.
Office Action dated Aug. 17, 2009 issued in copending U.S. Appl. No. 11/819,219.
Office Action dated Jun. 11, 2009 issued in copending U.S. Appl. No. 11/714,172.

* cited by examiner

*Primary Examiner*—Sandra L Brase
(74) *Attorney, Agent, or Firm*—Nixon & Vanderhye PC

(57) ABSTRACT

A charging device includes a long electrode, a cleaning member, a timing device, a drive source, a load measuring device, and a control device. The drive source moves the cleaning member in the outward direction for a first time period after the outward passage time and then reverses the cleaning member in the homeward position. The load measuring device measures driving load imposed on the drive source while the cleaning member is being moved. The control device controls motion of the drive source to turn the cleaning member from the outward direction to the homeward direction at a predetermined objective point near the second end, based on sum of driving loads imposed on the drive source while the cleaning member is being moved from the first point to a second point located along the outward direction.

21 Claims, 6 Drawing Sheets

CHARGING DEVICE

CROSS REFERENCE

This Nonprovisional application claims priority under 35 U.S.C. §119(a) on Patent Application No. 2006-189639 filed in Japan on Jul. 10, 2006, the entire contents of which are hereby incorporated by reference.

BACKGROUND OF THE TECHNOLOGY

The technology relates to a charging device for charging to a uniform potential a circumferential surface of a photoreceptor of an electrophotographic image forming apparatus.

Electrophotographic image forming apparatus include a photoreceptor and a charging device for charging a circumferential surface of the photoreceptor to a uniform potential. The charging device may be a noncontact charging device out of contact with the photoreceptor. The noncontact charging device includes an electrode. Application of high voltage to the electrode causes the electrode to discharge so as to charge the circumferential surface of the photoreceptor. A portion of the electrode that generates a high-voltage electric field attracts ambient dust. Large amounts of dust on the electrode prevent proper discharge thereof.

JP H11-338265A discloses a charging device that includes a needle electrode and a pair of pads. The electrode has a plurality of needles arrayed perpendicularly to a direction in which a circumferential surface of a photoreceptor moves. The pads are supported on both sides of the needle array of the electrode. Movement of the pads along the needle array brings the pads into contact with the needles in order so as to remove dust from the needles.

When the electrode is cleaned by reciprocating a cleaning member between a first end and a second end of the electrode along the surface of the photoreceptor, however, a high level of contamination of the electrode in an outward movement of the cleaning member requires a large driving load to be put on a drive source for moving the cleaning member. This reduces traveling speed of the cleaning member. In a homeward movement of the cleaning member, in contrast, the electrode has been cleaned and the level of contamination of the electrode becomes lower. Thus, a smaller driving load is required to be put on the drive source, and the traveling speed of the cleaning member becomes higher than in the outward movement. Therefore, supplying the same amount of power to the drive source in both of the outward and homeward movements causes the cleaning member to be moved at different speeds in the outward and homeward movements.

The conventional device includes a position sensor positioned near the first end. The cleaning member is reversed in a homeward direction after a predetermined time has elapsed since a point in time when the position sensor detects the cleaning member moving in an outward direction. According to levels of contamination of the electrode, this arrangement causes the cleaning member to be reversed from the outward direction to the homeward direction, or to be stopped, determined as having returned to the side of the first end, at an undesirable time.

This may cause the following problems. First, the cleaning member may be prevented from reaching an objective point near the second end in the outward movement, and thus portions of the electrode 2 may be left uncleaned. Second, the cleaning member may overshoot the second end in the outward movement and damage components of the device arranged near the second end. Third, the cleaning member may be prevented from reaching the first end in the homeward movement. Finally, the cleaning member may overshoot the first end in the homeward movement and damage components of the device arranged near the first end.

A feature of the technology is to provide a charging device that allows an electrode to be cleaned with a high efficiency while preventing damage to the device.

SUMMARY OF THE TECHNOLOGY

A charging device includes a long electrode, a cleaning member, a timing device, a drive source, a load measuring device, and a control device. The electrode is mounted over a surface of a photoreceptor. The cleaning member is mounted to be movable along the length of the electrode in an outward direction from a first end to a second end of the electrode, and in a homeward direction from the second end to the first end, while in contact with the electrode. The timing device measures time that has elapsed since outward passage time at which the cleaning member passes through a first point in the outward direction. The first point is located near the first end. The drive source moves the cleaning member in the outward direction for a first time period after the outward passage time and then reverses the cleaning member in the homeward position. The load measuring device measures driving load imposed on the drive source while the cleaning member is being moved. The control device controls motion of the drive source to turn the cleaning member from the outward direction to the homeward direction at a predetermined objective point near the second end, based on sum of driving loads imposed on the drive source while the cleaning member is being moved from the first point to a second point located along the outward direction.

DETAILED DESCRIPTION OF THE TECHNOLOGY

Figure 1:
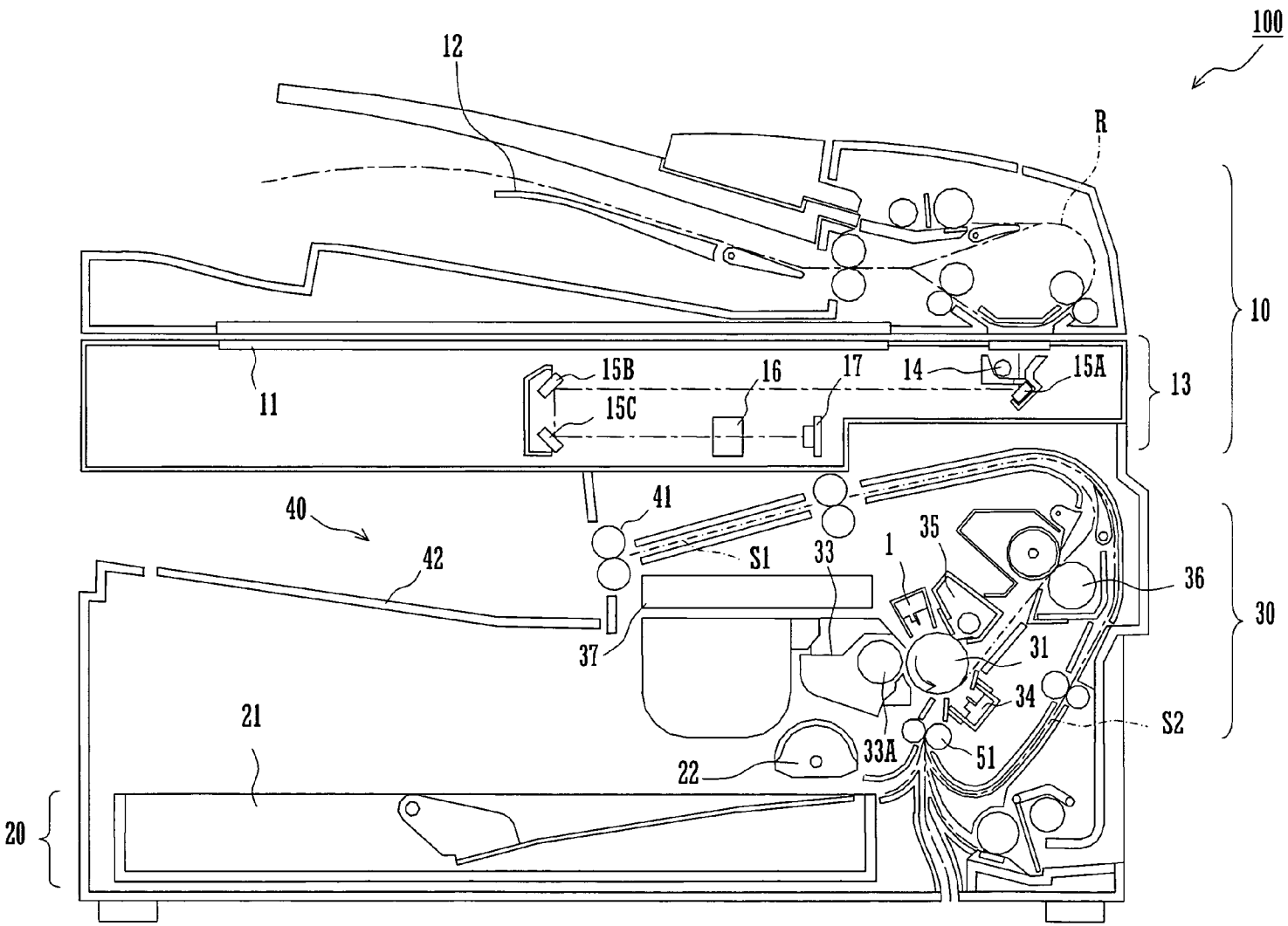
FIG. 1 is a cross-sectional view of an image forming apparatus that includes a charging device.

With reference to the accompanying drawings, preferred embodiments of the technology will be described below. FIG. 1 is a cross-sectional view of an image forming apparatus 100 that includes a charging device 1. The apparatus 100 forms an image on paper (including recording medium such as OHP) in any one of copier, printer, and facsimile modes as selected by a user. The apparatus can print images on both sides of paper.

The apparatus 100 includes a document reading section 10, a paper feeding section 20, an image forming section 30, a paper output section 40, and an operating panel section (not shown). Positioned at top of the apparatus 100, the section 10 has a glass platen 11, a document tray 12, and an optical scanning system 13. The system 13 has a light source 14, reflecting mirrors 15A to 15C, an optical lens 16, and a charge coupled device (CCD) 17. The source 14 irradiates with light an original document placed on the platen 11 or being transported on a document transport path R from the tray 12. The mirrors 15A to 15C reflect the light reflected from the document and direct it to the lens 16. The lens 16 focuses the reflected light on the CCD 17. The CCD 17 outputs an electric signal according to the amount of the reflected light.

Positioned at bottom of the apparatus, the paper feeding section 20 has a paper feeding tray 21 and a pick-up roller 22. The tray 21 stores therein paper to be fed into a paper transport path S1 in an image forming process. The roller 22 is rotated to feed paper from the tray 21 into the path S1.

The image forming section 30 is positioned near a manual feeding tray (not shown) below the section 10. The section 30 has a laser scanning unit (LSU) 37, a photoreceptor drum 31, and a fusing device 36. Around the drum 31, the charging device 1, a developing device 33, a transfer device 34, and a cleaning unit 35 are arranged, in that order, along a rotational direction of the drum 31 as indicated by an arrow in FIG. 1.

Positioned above the tray 21, the paper output section 40 has paper output rollers 41 and a paper output tray 42. The rollers 41 output paper transported on the path S1, to the tray 42. The rollers 41 are rotatable in a forward direction to output paper and in a reverse direction. In double-sided image formation, the rollers 41 are rotated in the reverse direction while nipping therebetween paper transported on the path S1 and bearing an image on a first side, to send the paper into a paper transport path S2. The paper is thus reversed, with a second side facing the drum 31 for transfer of a toner image thereto. On the tray 42, paper output by the rollers 41 are accumulated into a stack.

When a start key on the operating panel section is pressed, the apparatus 100 rotates the roller 22 to feed paper into the path S1. The fed paper is transported by registration rollers 51 provided on the path S1.

The rollers 51 are not rotating when a leading end of the paper reaches the rollers 51. The rollers 51 start to rotate when the leading end of the paper meets a leading end of a toner image formed on the drum 31 between the drum 31 and the device 34.

Image data read by the section 10 undergoes image processing on the conditions entered through the operating panel section and then sent as print data to the LSU 37. The device 1 charges the surface of the drum 31 to a predetermined potential. The LSU 37 forms an electrostatic latent image on the charged surface by irradiating the surface of the drum 31 with a laser beam through a polygon mirror (not shown) and lenses (also not shown). Then, toner adhering to a circumferential surface of an MG roller 33A, which is provided in the device 33, is attracted by and sticks to the surface of the drum 31 according to the potential gaps on the surface, so that the electrostatic latent image is developed into a toner image.

The device 34 transfers the toner image from the drum 31 to paper. The unit 35 removes and collects toner remaining on the drum 31 after the transfer process.

After the transfer process, the paper is heated and pressurized while passing through the fusing device 36, so that the toner image is fused and fixed to the paper. Then, the paper is output to the tray 42 by the rollers 41.

Figure 2B:
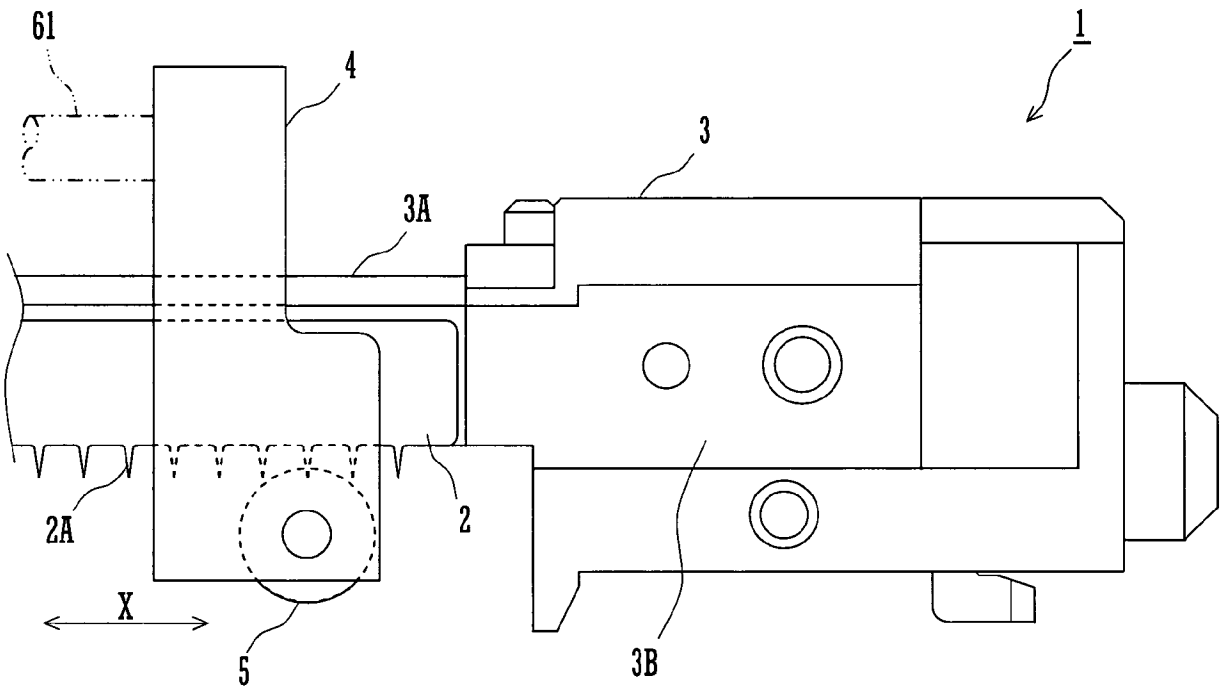
FIG. 2B is a right side view of a relevant part of the device.
Figure 2A:
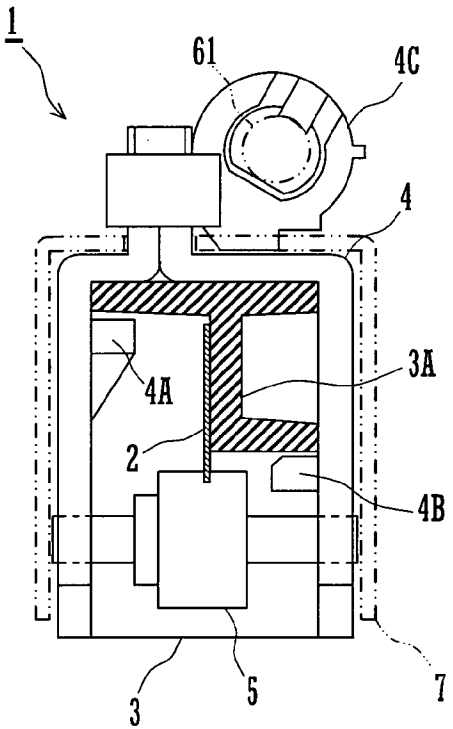
FIG. 2A is a front cross-sectional view of the charging device.

FIG. 2A is a front cross-sectional view of the device 1. FIG. 2 is a right side view of a relevant part of the device 1. The device 1 includes a needle electrode 2, a holder 3, a support 4, a cleaning roller 5, a screw 61, and a casing 7. The device 1 is located above the drum 31.

The electrode 2 is a thin metal strip with a plurality of needles 2A extending downward from its bottom. The needles 2A are regularly spaced along the length of the electrode 2. The needles 2A are arrayed along a direction X that is parallel to a direction of the length of the electrode 2. The device 1 is positioned with the length direction of the electrode 2 parallel to an axis of the drum 31. The direction X is therefore parallel to the axis of the drum 31. The length of the electrode 2 is longer than an axial length of the circumferential surface of the drum 31.

The holder 3 is formed of an insulating material such as resin. The holder 3 has a holding section 3A and a terminal section 3B. The section 3A holds the electrode 2 and is longer than a distance between both endmost needles 2A of the electrode 2. The section 3A has a cross-sectional shape, as shown by hatches in FIG. 2A, with respect to a plane normal to the direction X. The section 3B stores therein a terminal (not shown) for connecting the electrode 2 to a high-voltage power supply (also not shown).

The support 4 is open at bottom and mounted slidably on the outside of the section 3A. The support 4 has projections 4A and 4B formed on inner side surfaces thereof. The support 4 holds the section 3A vertically between top inner surface thereof and the projections 4A and 4B, and horizontally between the inner side surfaces. This prevents rotation and other motions of the support 4 in the plane normal to the direction X. At its top, the support 4 has a hole 4C with a female thread cut.

The cleaning roller 5 is rotatably mounted on a lower end of the support 4. As an example, the roller 5 includes an elastic body containing an abrasive lower in hardness than the material of the electrode 2 and higher in hardness than dust such as toner. Tips of the needles 2A sink in a circumferential surface of the roller 5.

The roller 5 can be formed of a suitable elastic body selected by experiment out of known rubber or resinous materials on the condition that the material deforms elastically without being cut easily when the needles 2A sink into it and come out of it. The abrasive can be selected suitably from known materials on the condition that the material can remove toner and dust from the surfaces of the needles 2A without damaging the surfaces. The abrasive can be contained in the elastic body by a known method.

A rear end of the screw 61 is fitted in the hole 4C. A front end (not shown) of the screw 61 protrudes from the front end of the holder 3.

The casing 7 extends over the length of the holder 3 and covers the support 4. The casing 7 shields the electrode 2.

When a high voltage is applied to the electrode 2 through the terminal stored in the section 3B, the applied electric field concentrates at the tips of the needles 2A, so that the tips are liable to discharge. This causes the needles 2A to discharge to the surface of the drum 31, so that the surface is charged to the predetermined potential.

The cross section of the section 3A that is normal to the direction X is uniform in shape at least between both endmost needles 2A. As discussed earlier, the support 4 is mounted on the outside of the section 3A and prevented from rotating and moving otherwise in the plane normal to the direction X. The support 4 is slidable along the direction X along the section 3A at least between both endmost needles 2A.

Figure 3:
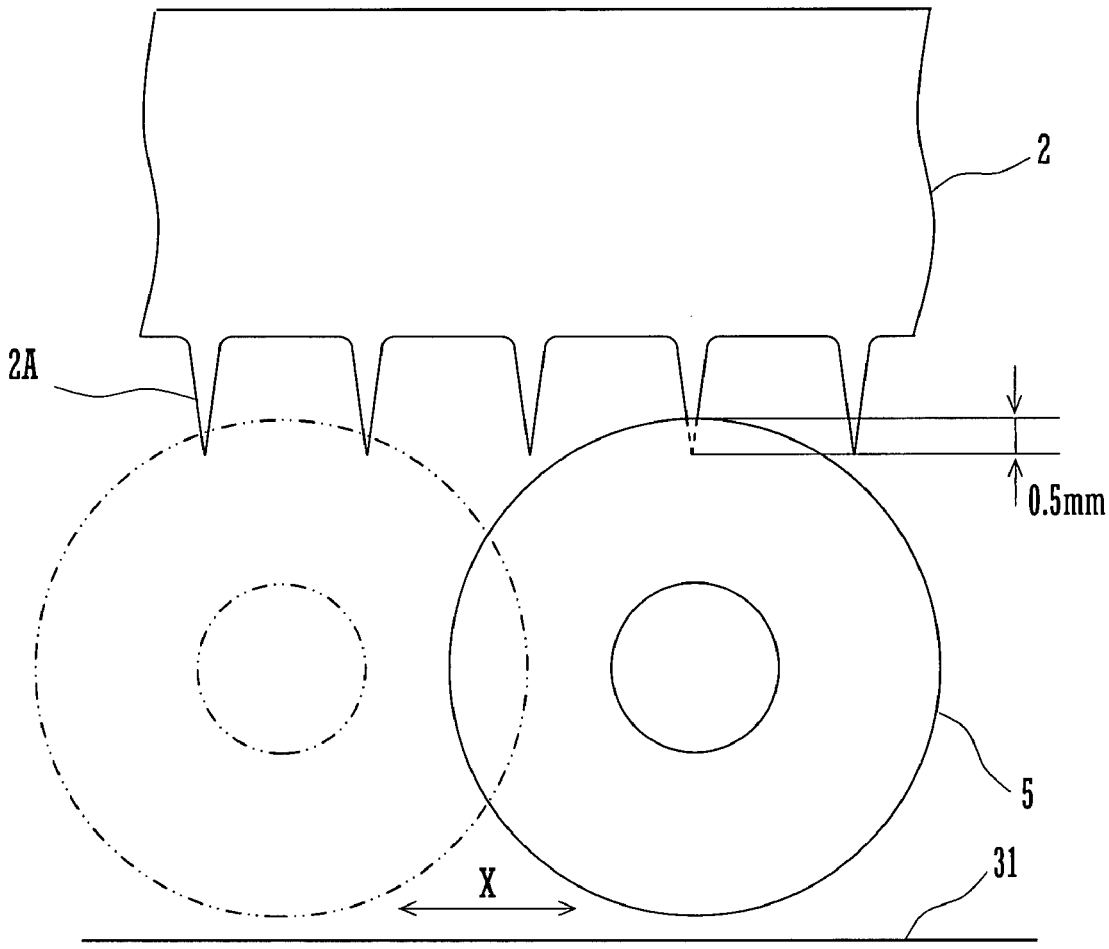
FIG. 3 is a view illustrating a cleaning operation of a cleaning roller.

FIG. 3 is a view illustrating a cleaning operation of the roller 5. The tips of the needles 2A sink in the circumferential surface of the roller 5, which is supported rotatably by the support 4. While the support 4 is moving with the roller 5 along the direction X, the tips of the needles 2A sink in order in the surface of the roller 5. While moving along the direction X, the roller 5 is rotated by resistance acted on the surface thereof by the needles 2A.

The cleaning roller 5 is positioned between the electrode 2 and the circumferential surface of the drum 31. It is essential that the roller 5 be as large as possible in diameter without being in contact with the surface of the drum 31. While the roller 5 is moving along the direction X, the tip of at least one of the needles 2A is sinking in the circumferential surface of the roller 5. This ensures that the roller 5 is rotated when moving along the direction X, thereby minimizing damage to the surface of the roller 5 by the tips of the needles 2A and deformation of the needles 2A by the surface of the roller 5.

The roller 5 is supported by the support 4 in such a manner that the needles 2A sink as deep as about 0.5 mm into the surface of the roller 5. While the support 4 is moving with the roller 5 along the direction X, the tips of the needles 2A sink gradually into the roller 5 and subsequently come gradually out of it. While the tips of the needles 2A are sinking into and coming out of the roller 5, their overall surfaces come into contact with the elastic body of the roller 5 and are ground by the abrasive contained in this body. Because the roller 5 rotates while the needles 2A are sinking into it and coming out of it in order, at least adjacent needles 2A sink in different positions into the roller 5. This ensures that the overall surfaces of the tips of the needles 2A are cleaned.

Figure 4:
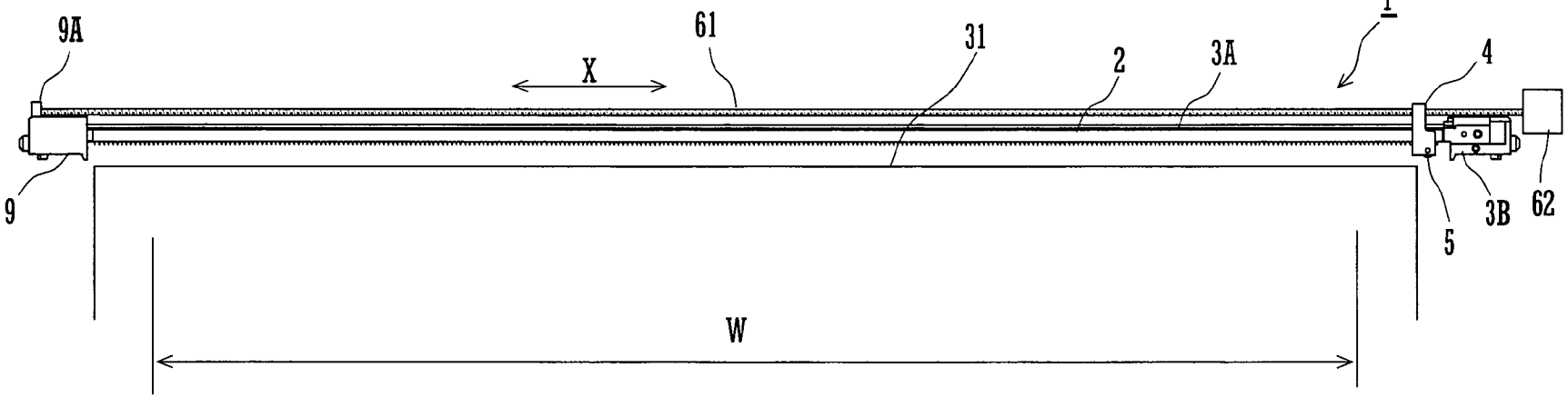
FIG. 4 is a right side view of the device.

FIG. 4 is a right side view of the device 1. The screw 61 is positioned at the top of the device 1 and extends over the roughly whole length of the holder 3. As discussed earlier, the rear end of the screw 61 is fitted in the hole 4C. The holder 3 also includes a mounting section 9 formed at its frond end. The section 9 is nearly identical in outer shape to the section 3B. The section 9 has a bearing 9A formed at the top. The front end of the screw 61 is fitted in the bearing 9A.

The sections 3B and 9 are positioned outside an image formation area W on the circumferential surface of the drum 31 when the device 1 is mounted in the apparatus 100. In a stand-by state in which the roller 5 is not cleaning the needles 2A, meanwhile, the support 4 is positioned in a home position set outside the area W. Accordingly, the support 4 and the sections 3B and 9 do not obstruct image formation on the surface of the drum 31.

The screw 61 is rotated by a motor 62 that is rotatable in forward and reverse directions.

The support 4 is prevented from moving with respect to the holder 3 in the plane normal to the direction X and from rotating around axes along the direction X. The torque of the screw 61 is converted into force for moving the support 4 along the axis thereof. The motor 62 rotates the screw 61 in the forward and reverse directions to reciprocate the support 4 on the section 3A along the direction X. In this reciprocation, the tips of the needles 2A sink in order in the surface of the roller 5 being rotated. Cleaning the electrode 2 can be automated by activating the motor 62 at predetermined times.

While the tips of the needles 2A are sinking into and coming out of the roller 5, their overall surfaces come into contact with the roller 5. This ensures that the overall surfaces of the tips of the needles 2A are cleaned without deforming the needles 2A and causing fibers to stick to the needles 2A.

Figure 5:
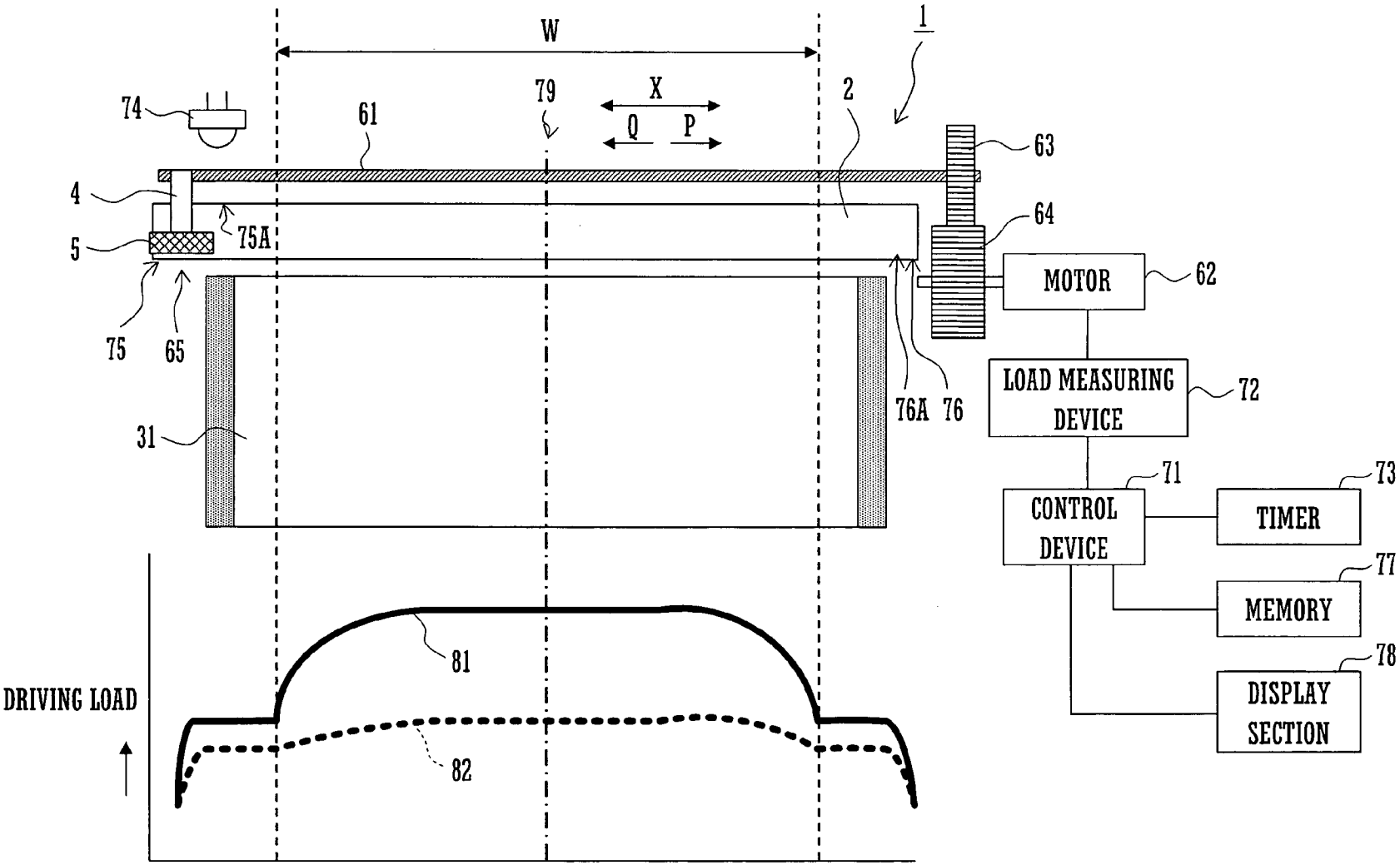
FIG. 5 is an explanatory drawing showing driving load imposed on a motor when the cleaning roller is being moved outward and homeward.

FIG. 5 is an explanatory drawing showing driving load imposed on the motor 62 when the roller 5 is being moved outward and homeward. The screw 61 is connected to the motor 62 through gears 63 and 64. The screw 61 is rotated by the motor 62 through gears 63 and 64. A load measuring device 72 measures driving load imposed on the motor 62 when the motor 62 rotates the screw 61 to move the support 4. The measuring result of the device 72 is sent to a control device 71.

To the device 71, a timer 73 is connected for sending timing data to the device 71. A memory 77 is also connected to the device 71. The memory 77 stores therein data such as on a reference driving load (i.e., a driving load imposed on the motor 62 during the movement of the support 4 when the electrode 2 is not contaminated with dust) and the number of paper sheets to be printed during a period between preceding and upcoming cleaning operations.

A home position 65 for the support 4 is set at a predetermined position near a first end 75 of the length of the electrode 2. The support 4 is in the home position 65 in the stand-by state. A position sensor 74 is located at a first point 75A near and downstream of the position 65 in an outward direction P. The sensor 74 separately detects the support 4 moving in the outward direction P and in a homeward direction Q and sends the movement data to the device 71.

A predetermined objective point 76A is set near a second end 76, opposite to the first end 75, of the length of the electrode 2. The support 4 is designed to start in the direction P from the position 65, turn at the point 76A, and go back in the direction Q to the position 65.

The position 65 and the points 75A and 76A are positioned outside the image formation area W.

The device 71 detects, through the sensor 74, the support 4 passing through the point 75A in the outward direction P. The device 71 also measures, through the timer 73, a period of time elapsed since the time of outward passage of the support 4. After a predetermined first time period has elapsed since the outward passage time, the device 71 reverses the support 4 in the homeward direction Q by rotating the motor 62 in the reverse direction.

When the support 4 is to be moved in the direction P, the level of contamination of the electrode 2 is high. Therefore, a large driving load is imposed on the motor 62 to move the support 4 in the direction P, as shown by a thick solid line 81 in FIG. 5. When the support 4 is to be moved in the direction Q, in contrast, the level of contamination is lower because the electrode 2 has been cleaned during the outward movement of the support 4. Therefore, a smaller driving load is imposed on the motor 62 to move the support 4 in the direction Q.

Figure 6:
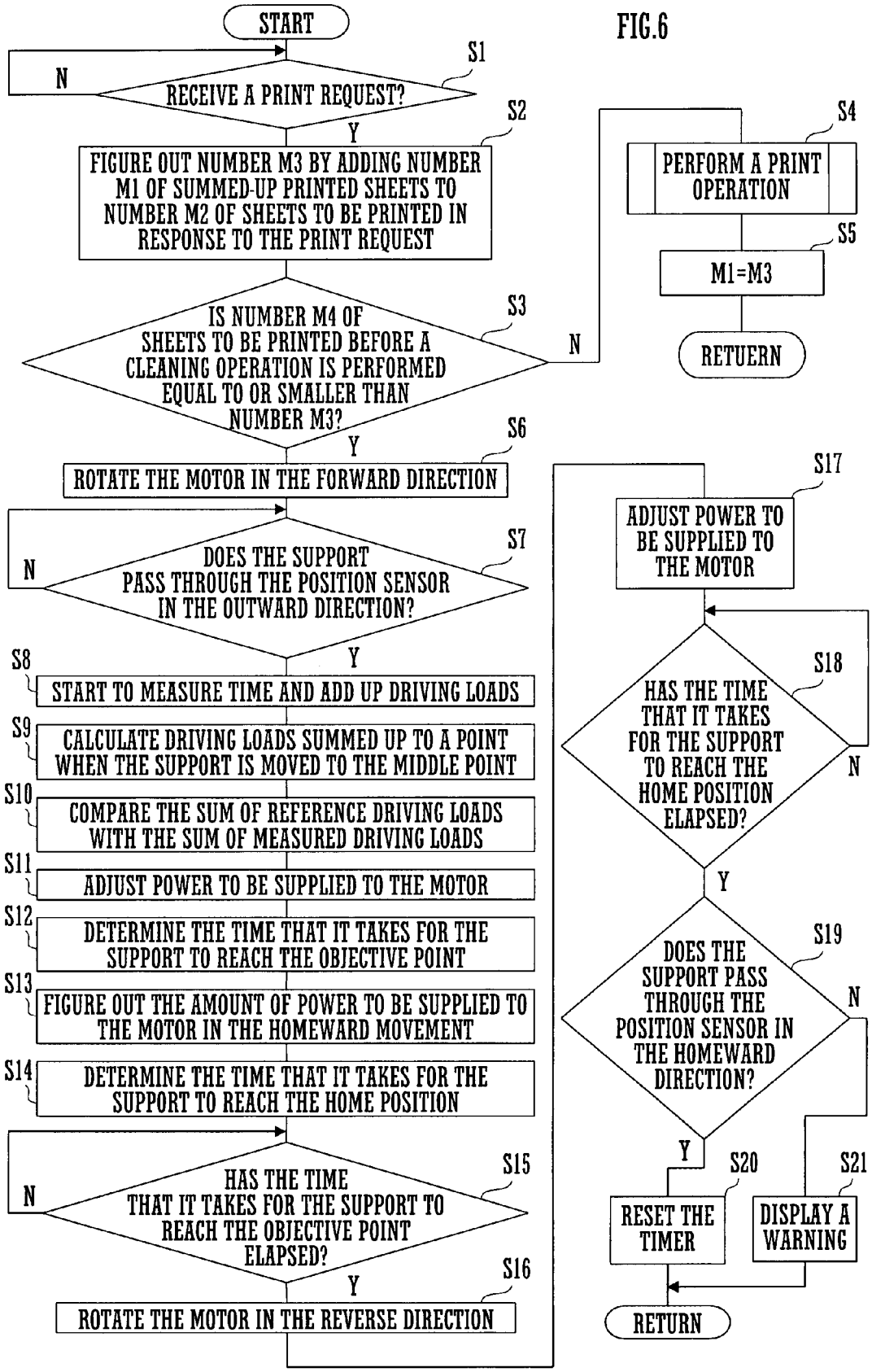
FIG. 6 is a flowchart showing part of steps performed by a control device.

FIG. 6 is a flowchart showing part of steps performed by the device 71. Upon receipt of a print request (step S1), the device 71 adds, to the number M1 of printed sheets summed up after a preceding cleaning operation, the number M2 of sheets to be printed in response to the request, to figure out the number M3 (step S2). The device 71 starts a cleaning operation when the number of sheets printed after a preceding cleaning operation reaches a predetermined number M4. When the device 71 compares the number M3 with the number M4 (step S3) and determines that the number M4 is not equal to or smaller than the number M3, i.e., the number M3 is smaller than the number M4, the device 71 performs a print operation (step S4) and defines the number M3 as the number M1 (step S5).

When determining in step S3 that the number M4 is equal to or smaller than the number M3, the device 71 moves the support 4 in the direction P by rotating the motor 62 in the forward direction (step S6). When detecting passage of the support 4 through the sensor 74 in the direction P (step S7), the device 71 causes the timer 73 to start time measurement and concurrently starts to add up driving loads measured by the device 72 (step S8).

The memory 77 stores therein time M5 that it takes for the support 4 to move from the first point 75A to the objective point 76A when the level of contamination of the electrode 2 is a predetermined one. The device 71 calculates driving loads summed up to a point when the support 4 is moved in the direction P for half of the time M5 (step S9). At this point, the support 4 is thought to be positioned at a middle point 79 between the home position 65 and the objective point 76A, i.e., close to a position opposite an axial central portion of the drum.

As discussed earlier, the memory 77 stores therein the reference driving load, i.e., the driving load imposed on the motor 62 during the movement of the support 4 when the electrode 2 is not contaminated with dust. The memory 77 also stores therein relationship between power to be supplied to the motor 62 and differences between the sum of reference driving loads from the position 65 to the point 79 and the sum of driving loads from the position 65 to the point 79 according to each of various levels of contamination of the electrode 2.

The device 71 compares the sum of reference driving loads from the position 65 to the point 79 with the sum of driving loads from the position 65 to the point 79 as actually measured (step S10), and adjusts power to be supplied to the motor 62 (step S11).

For example, the greater the difference between the sum of driving loads as actually measured and the sum of reference driving loads, the more power is supplied to the motor 62 to increase the traveling speed of the support 4. The smaller the difference, in contrast, the less power is supplied to the motor 62 to reduce the traveling speed of the support 4.

This speed adjustment allows the support 4 to be positioned close to the point 76A after being moved in the direction P for the time M5, so that the support 4 is prevented from failing to reach the point 76A and from overshooting the second end 76. This ensures that fewer portions of the electrode 2 are left uncleaned by the roller 5 and that the electrode 2 is thus cleaned with an enhanced effectiveness, while preventing damage to portions of the device 1 around the end 76.

The device 71 determines time that it takes for the support 4 to reach the point 76A at the adjusted traveling speed (step S12).

The memory 77 further stores therein relationship between the sum of driving loads imposed on the motor 62 during the outward movement from the position 65 to the point 79 and power to be supplied to the motor 62 in the homeward movement. Based on the sum of driving loads during the outward movement from the position 65 to the point 79, the device 71 figures out the amount of power to be supplied to the motor 62 in the homeward movement (step S13).

The device 71 determines time that it takes for the support 4 to reach the position 65 at the adjusted power (step S14).

After the time determined in step S12, i.e., the time taken for the support 4 to reach the point 76A at the adjusted traveling speed, has elapsed (step S15), the device 71 rotates the motor 62 in the reverse direction (step S16).

The device 71 adjusts the amount of power to be supplied to the motor 62 in the homeward movement, to the amount figured out in step S13 (step S17). This allows the roller 5 to stop at a position closer to the position 65 in the homeward movement, so that the support 4 is prevented from failing to reach the position 65 and from overshooting the first end 75. This ensures that fewer portions of the electrode 2 are left uncleaned by the roller 5 and that the electrode 2 is thus cleaned with an enhanced effectiveness, while preventing damage to portions of the device 1 around the end 75.

After the time determined in step S14 plus a predetermined extra time has elapsed (step S18), the device 71 determines whether the sensor 74 has detected the support 4 moving in the direction Q (step S19).

When determining in step S19 that the support 4 has been detected, the device 71 judges that the support 4 has returned to the position 65, and resets the timer 73 (step S20).

When determining that the support 4 has not been detected, the device 71 judges that the support 4 has traveling trouble between the position 65 and the point 76A, displays a warning on a display section 78, and stops a print operation (step S21).

In the embodiment, as described above, the power to be supplied to the motor 62 or the time at which the support 4 is reversed is adjusted based on the sum of driving loads from the point 75A to the point 79. If the driving load is measured over too short a distance, the level of contamination of the electrode 2 cannot be correctly measured. In the embodiment, however, the contamination level is correctly measured because the measurement is based on the sum of driving loads from the point 75A to the point 79. This allows proper adjustment of the subsequent traveling speed, or the reversing time, of the support 4. If the driving load is measured over too long a distance, the subsequent traveling speed of the support 4 has to be adjusted over a short distance. This prevents the support 4 from reaching the point 76A, or necessitates the support 4 moving at an unreasonably high speed. In the embodiment, however, the contamination level is measured based on the sum of driving loads from the point 75A to the point 79. This allows reasonable adjustment of the traveling speed of the support 4 after the driving load is measured, so that the support 4 is brought close to the point 79.

In step S11, the power to be supplied to the motor 62 may be adjusted to move the support 4 at such a speed as to maximize the effectiveness of cleaning by the roller 5.

In step S13, as an example, the larger the sum of driving loads during the outward movement from the position 65 to the point 79, the more power is applied to the motor 62 in the homeward movement. This is because, if the sum of driving loads during the outward movement is large, it is thought that the level of contamination of the electrode 2 will be higher even after the cleaning in the outward movement, and driving load imposed on the motor 62 will be heavier in the homeward movement, than in a situation when the sum of driving loads during the outward movement is small.

In step S13, it is preferable to set the power to be supplied to the motor 62 so that the traveling speed of the support 4 becomes lower in the homeward movement than in the outward movement. This allows the electrode 2 to be cleaned quickly in the outward movement and with an enhanced effectiveness in the homeward movement due to the lower traveling speed of the support 4 in the homeward movement. Accordingly, the electrode 2 can be cleaned in a short time and with an enhanced effectiveness.

In step S11, the device 71 can adjust time to reverse the motor 62, instead of adjusting the power to be supplied to the motor 62. For example, the greater the difference between the sum of actually measured driving loads and the sum of reference driving loads, the longer the first time period can be extended to delay the time to reverse the motor 62. The smaller the difference, in contrast, the shorter the first time period can be cut down to bring forward the time to reverse the motor 62. This also ensures that fewer portions of the electrode 2 are left uncleaned by the roller 5 and that the electrode 2 is thus cleaned with an enhanced effectiveness, while preventing damage to portions of the device 1 around the end 75.

The device 71 performs the cleaning operation of moving the roller 5 along the electrode 2 in at least one of the following periods: a warm-up period just after the apparatus 100 starts to be energized; an initialization period just before a print operation is started; and a post-processing period just after a print operation is ended. Cleaning the electrode 2 in the predetermined periods other than a period when a print operation is being performed enhances image quality as well as printing efficiency.

For more effective cleaning of the electrode 2, it is preferable that the traveling speed of the support 4 is low.

Alternatively, a corona charging electrode may be used instead of the needle electrode 2. In this case, it is preferable that the traveling speed of the support 4 is high.

It is not essential that the cleaning member be a cleaning roller 5, but it is essential that this member be a rotor supported rotatably by the support 4.

Alternatively, the motor 62 may be small in size and connected electrically to a power source provided in the apparatus 100 when the device 1 is mounted in the apparatus 100. Alternatively, the motor 62 may be mounted in the apparatus 100. In this case, the rear end of the screw 61 may be coupled mechanically to the rotational shaft of the motor when the device 1 is mounted in the apparatus 100.

The technology being thus described, it will be obvious that the same may be varied in many ways. Such variations are not to be regarded as a departure from the spirit and scope of the technology, and all such modifications as would be obvious to one skilled in the art are intended to be included within the scope of the following claims.

What is claimed is:

1. A charging device comprising:

a long electrode mounted over a surface of a photoreceptor, the electrode having a first end and a second end of length thereof;

a cleaning member mounted to be movable along the length of the electrode in an outward direction from the first end to the second end, and in a homeward direction from the second end to the first end, while in contact with the electrode;

a timing device for measuring time that has elapsed since outward passage time at which the cleaning member passes through a first point in the outward direction, the first point being located near the first end;

a drive source for moving the cleaning member in the outward direction for a first time period after the outward passage time and then reversing the cleaning member in the homeward direction;

a load measuring device for measuring driving load imposed on the drive source while the cleaning member is being moved; and a control device for controlling motion of the drive source to turn the cleaning member from the outward direction to the homeward direction at a predetermined objective point near the second end, based on sum of driving loads imposed on the drive source while the cleaning member is being moved from the first point to a second point located along the outward direction.

2. The charging device according to claim 1, wherein the control device adjusts power to be supplied to the drive source.

3. The charging device according to claim 2, wherein the control device increases power to be supplied to the drive source to cause the cleaning member to move faster.

4. The charging device according to claim 1, wherein the control device adjusts the first time period.

5. The charging device according to claim 1, further comprising a position sensor for detecting the cleaning member passing through the first point.

6. The charging device according to claim 5, wherein the control device sends out a warning to alert a user that the cleaning member has traveling trouble when the position sensor does not detect the cleaning member moving in the homeward direction within a second time period after the outward passage time.

7. The charging device according to claim 1, wherein the control device causes the cleaning member to be moved while in contact with the electrode, in at least one of:

(a) a warm-up period just after the charging device starts to be energized;

(b) an initialization period just before a print operation is started; and (c) a post-processing period just after a print operation is ended.

8. The charging device according to claim 1, further comprising a support for supporting the cleaning member rotatably, wherein:

the electrode is a needle electrode with a plurality of needles arrayed along a direction, the support is mounted movably along the array of the needles, and while the cleaning member is being moved, tips of the needles sink into, and subsequently come out of, the cleaning member in order.

9. The charging device according to claim 8, wherein the control device sets traveling speed of the cleaning member lower in the homeward movement than in the outward movement.

10. The charging device according to claim 1, wherein the second point is at an interim location between the first end and the second end.

11. The charging device according to claim 10, wherein the control device compares the sum of the driving loads imposed on the drive source while the cleaning member is moved from the first point to the second point to a reference value, and then selectively alters the power supplied to the drive source based on the result of that comparison.

12. The charging device according to claim 11, wherein if the sum of the driving loads is larger than the reference value, the control device increases the power supplied to the drive source to cause the cleaning member to move faster.

13. The charging device according to claim 12, wherein if the sum of the driving loads is larger than the reference value, the control device increases the power supplied to the drive source by an amount that is relative to a magnitude of the difference between sum of the driving loads and the reference value.

14. The charging device according to claim 10, wherein the control device compares the sum of the driving loads imposed on the drive source while the cleaning member is moved from the first point to the second point to a reference value, and then selectively adjusts the duration of the first time period based on the result of that comparison.

15. The charging device according to claim 14, wherein if the sum of the driving loads is larger than the reference value, the control device increases the duration of the first time period.

16. The charging device according to claim 15, wherein if the sum of the driving loads is larger than the reference value, the control device increases the duration of the first time period by an amount that is relative to a magnitude of the difference between sum of the driving loads and the reference value.

17. A charging device, comprising:

a charging electrode configured to charge a surface of a photoreceptor, the charging electrode having first and second ends;

a cleaning member mounted to be movable along the length of the charging electrode in an outward direction from the first end to the second end, and in a homeward direction from the second end to the first end, wherein movement of the cleaning member along the length of the charging electrode acts to clean the charging electrode;

a timing device that measures a time that has elapsed after the cleaning member passes a first point while traveling in the outward direction, the first point being located near the first end;

a drive unit that causes the cleaning member to move in the outward direction for a first time period that begins when the cleaning member passes the first point, and that causes the cleaning member to reverse direction and move in the homeward direction; and a control device for controlling the drive unit such that the cleaning member moves slower in the homeward direction than in the outward direction.

18. The charging device according to claim 17, further comprising a load measuring device for measuring a driving load of the drive unit while the cleaning member is being moved, wherein the control device compares a reference value to the sum of the driving loads imposed on the drive unit while the cleaning member is moved from the first point to a second point at an interim location between the first end and the second end, and wherein the control device increases a power supplied to the drive unit if the reference value is smaller than the sum of the driving loads.

19. The charging device according to claim 18, wherein if the reference value is smaller than the sum of the driving loads, the control device increases the power supplied to the drive unit by an amount that is relative to a magnitude of the difference between sum of the driving loads and the reference value.

20. The charging device according to claim 17, further comprising a load measuring device for measuring a driving load of the drive unit while the cleaning member is being moved, wherein the control device compares a reference value to the sum of the driving loads imposed on the drive unit while the cleaning member is moved from the first point to a second point at an interim location between the first end and the second end, and wherein the control device increases the duration of the first time period if the reference value is smaller than the sum of the driving loads.

21. The charging device according to claim 20, wherein if the reference value is smaller than the sum of the driving loads, the control device increases the duration of the first time period by an amount that is relative to a magnitude of the difference between sum of the driving loads and the reference value.

* * * * *